US010072519B2

(12) United States Patent
Beers et al.

(10) Patent No.: US 10,072,519 B2
(45) Date of Patent: Sep. 11, 2018

(54) TURBINE NOZZLE FOR AIR CYCLE MACHINE

(71) Applicant: Hamilton Sundstrand Corporation, Windsor Locks, CT (US)

(72) Inventors: Craig M. Beers, Wethersfield, CT (US); Brent J. Merritt, Southwick, MA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 1332 days.

(21) Appl. No.: 13/869,053

(22) Filed: Apr. 24, 2013

(65) Prior Publication Data

US 2014/0322000 A1 Oct. 30, 2014

(51) Int. Cl.
*F01D 25/24* (2006.01)
*F01D 17/16* (2006.01)

(52) U.S. Cl.
CPC ..... *F01D 17/165* (2013.01)

(58) Field of Classification Search
CPC ..... F01D 5/005; F01D 5/141; F01D 5/147; F01D 5/228; F01D 9/041; F01D 9/048; F01D 9/045; F01D 17/141; F05D 2230/80; F05D 2230/90; F05D 2240/128; F05D 2260/95; F02C 1/02
See application file for complete search history.

(56) References Cited

U.S. PATENT DOCUMENTS 3,972,644 A 8/1976 Johnson
4,726,101 A 2/1988 Draghi et al.
4,798,515 A 1/1989 Hsia et al.
5,142,778 A * 9/1992 Smolinski ..... B23K 26/00 219/121.66
5,224,842 A * 7/1993 Dziorny ..... F04D 29/102 417/406
5,249,934 A * 10/1993 Merritt ..... F04D 29/5853 417/406
5,299,909 A 4/1994 Wulf
5,309,735 A 5/1994 Maher, Jr. et al.
5,311,749 A * 5/1994 McAuliffe ..... F02C 3/32 415/12
5,460,003 A * 10/1995 Nenov ..... F01D 9/045 415/186
5,522,134 A * 6/1996 Rowe ..... B23P 6/005 29/402.08
5,630,700 A 5/1997 Olsen et al.
6,109,867 A 8/2000 Portefaix
(Continued)

FOREIGN PATENT DOCUMENTS

CN 203292697 U 11/2013
JP H04292502 A 10/1992
(Continued)

*Primary Examiner* — Ninh H Nguyen

(74) *Attorney, Agent, or Firm* — Carlson, Gaskey & Olds, P.C.

(57) ABSTRACT

A nozzle for use in an air cycle machine has a plate. A plurality of vanes extends in a second axial direction away from the plate. The plurality of vanes extends for a height away from the plate and a width defined as the closest distance between two adjacent vanes, with a ratio of the nozzle height to the nozzle width being between 0.3563 and 0.4051. An air cycle machine and a method are also disclosed.

8 Claims, 3 Drawing Sheets

(56) References Cited

U.S. PATENT DOCUMENTS

| | | | | |
|---|---|---|---|---|
| 6,789,315 | B2 * | 9/2004 | Marques | B23P 6/002 228/119 |
| 6,810,666 | B2 * | 11/2004 | Lutz | F01D 17/167 415/158 |
| 6,942,183 | B2 | 9/2005 | Zywiak | |
| 7,322,202 | B2 | 1/2008 | Zywiak et al. | |
| 7,779,644 | B2 | 8/2010 | Decrissantis et al. | |
| 8,016,551 | B2 * | 9/2011 | Lin | F01D 9/045 415/163 |
| 8,113,787 | B2 * | 2/2012 | Barril | F01D 5/288 416/224 |
| 8,347,647 | B2 | 1/2013 | McAuliffe | |
| 2003/0177640 | A1 | 9/2003 | Marques et al. | |
| 2012/0156028 | A1 * | 6/2012 | Colson | F01D 25/28 415/208.2 |

FOREIGN PATENT DOCUMENTS

| | | | |
|---|---|---|---|
| JP | 2004263679 | A | 9/2004 |
| JP | 3910648 | B2 | 4/2007 |

* cited by examiner

TURBINE NOZZLE FOR AIR CYCLE MACHINE

BACKGROUND

This application relates to a turbine nozzle for use in an air cycle machine.

Air cycle machines are known and, typically, provide air as part of a cabin air conditioning and temperature control system on an aircraft.

An air cycle machine typically includes at least one turbine receiving a source of compressed air and driving a compressor. The combination of the turbine and compressor condition the air for use on the aircraft.

SUMMARY

A nozzle for use in an air cycle machine has a plate. A plurality of vanes extends for a height away from the plate and a width is defined as the closest distance between two adjacent vanes. A ratio of the height to the width is between 0.3563 and 0.4051. An air cycle machine and a method of repair are also disclosed.

These and other features may be best understood from the following drawings and specification.

DETAILED DESCRIPTION

Figure 1:
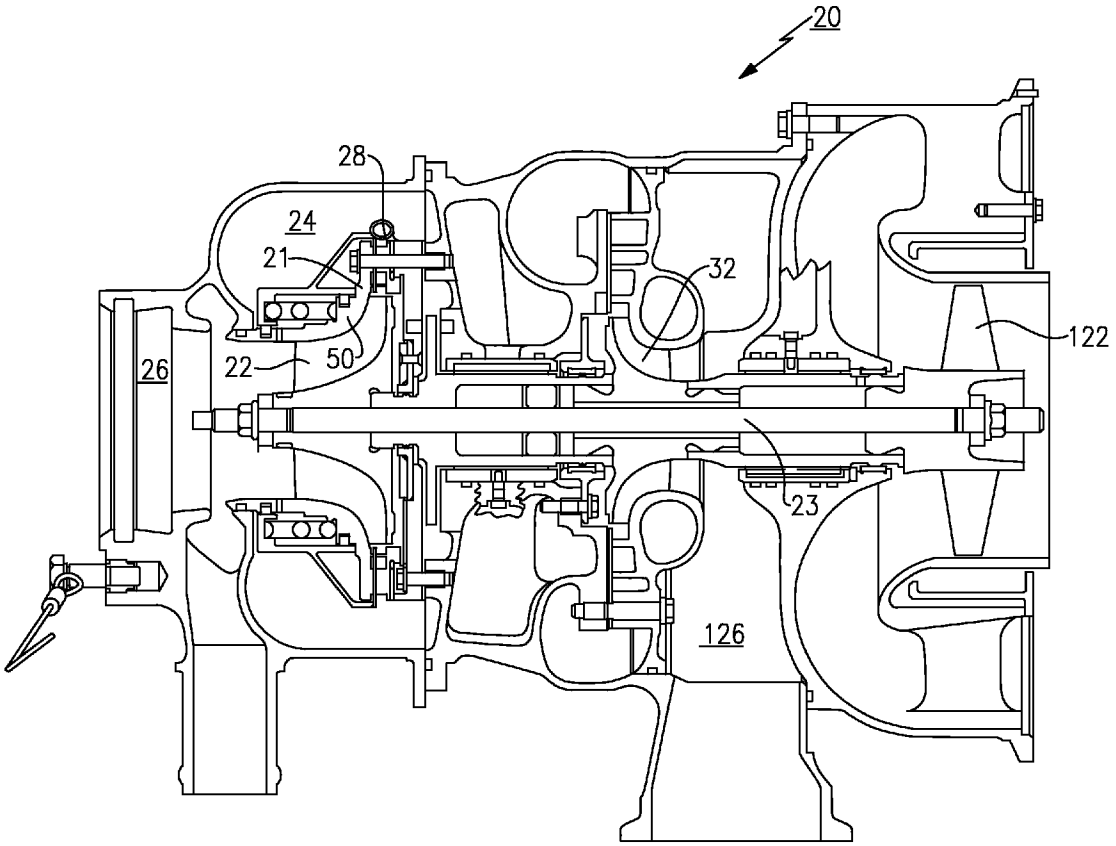
FIG. 1 shows an air cycle machine.

An air cycle machine 20 incorporates a turbine rotor 22 as shown in FIG. 1. A compressor rotor 32 receives a source of compressed air 126 and further compresses the air. The compressed air is delivered into an inlet and passes over turbine rotor 22 and to an outlet 26. Outlet 26 communicates into an aircraft cabin. The turbine rotor 22 drives a shaft 23 to, in turn, rotate a fan rotor 122 and a compressor rotor 32.

A primary nozzle 28 and secondary nozzle 21 condition the air from the inlet 24 as it approaches the turbine rotor 22.

Figure 2:
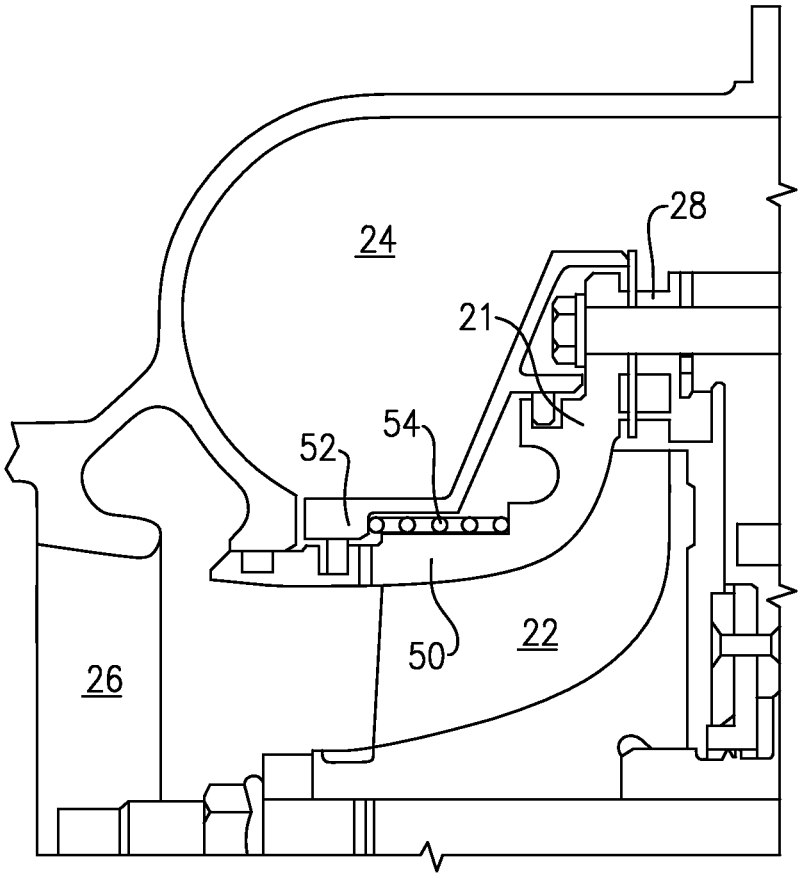
FIG. 2 shows a detail of a turbine rotor and nozzle.

As shown in FIG. 2, the turbine rotor 22 is positioned radially inwardly of a primary nozzle 28. A shroud 50 is incorporated with secondary nozzle 21, and is positioned to surround the rotor 22 and pass in a downstream direction from the primary nozzle 28. A nozzle slider 52 is biased by a spring 54 away from the nozzles 21 and 28.

During ground operation, a pressure in the turbine inlet chamber 24 is sufficiently high to overcome a force from spring 54. The slider 52, thus, sits in the closed position as illustrated.

At higher altitude, the relationship described above is no longer true and the slider 52 can move to the left as shown in this Figure and increase a nozzle flow area. More air is needed for cooling the aircraft cabin on the ground, and this nozzle combination provides more while an associated aircraft is on the ground.

Figure 3A:
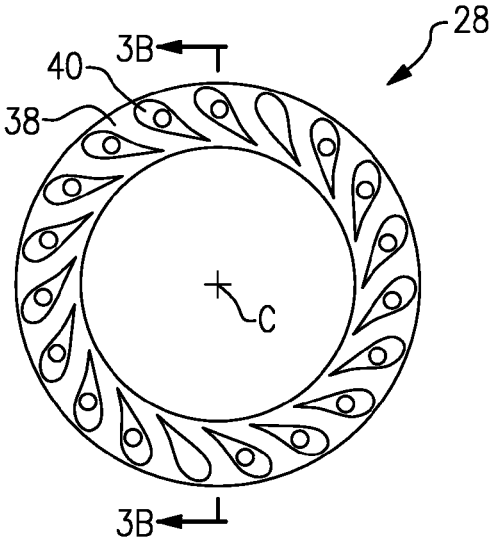
FIG. 3A shows a primary nozzle portion.

The primary nozzle 28 is illustrated in FIG. 3A having a plate 38 and a plurality of vanes 40 extending in an axial direction away from the plate 38. The axial direction is defined and measured relative to a center axis C.

Figure 3B:
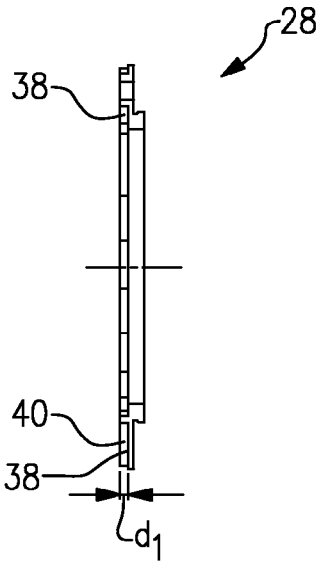
FIG. 3B is a cross-sectional view along line B-B of FIG. 3A.

As shown in FIG. 3B, the vanes 40 extend away from the plate 38 by a distance $d_1$.

Figure 3C:
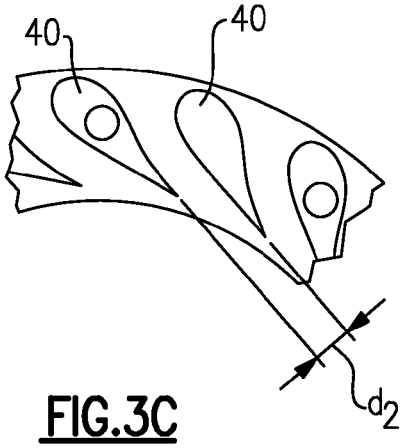
FIG. 3C shows a further detail.

As shown in FIG. 3C, adjacent vanes 40 are spaced by a width at a closest location $d_2$. In embodiments, there were 19 of the nozzle vanes 40. The nozzle height $d_1$ was 0.092 inch (0.234 centimeters). The nozzle width $d_2$ was 0.24 inch (0.610 centimeters). The width is measured tangent or parallel to the sides of the airfoils on adjacent vanes 40, and the point where they are most closely spaced. A total nozzle flow area between the plurality of vanes 19 at the closed position, was 0.423 square inches (2.729 square centimeters).

In embodiments, a ratio of $d_1$ to $d_2$ was between 0.3563 and 0.4051. The total nozzle flow area may range between 0.3963 and 0.4505 square inches (2.5565-2.9066 centimeters).

The nozzle 28 has a tungsten carbide erosion coating. Nozzle 287 is formed of a base of aluminium and then provided with a tungsten carbide erosion coating. Preferably, a high velocity oxy fuel coating technique is provided utilizing continuous burning.

A method of repairing an air cycle machine 20 includes the steps of removing a nozzle 28 from a location adjacent a turbine rotor in an air cycle machine. A replacement nozzle 28 is then mounted adjacent the turbine.

The secondary nozzle and shroud 21 is disclosed and claimed in co-pending application Ser. No. 13/869,051, entitled Turbine Nozzle and Shroud for Air Cycle Machines, and filed on even date herewith.

Although an embodiment of this invention has been disclosed, a worker of ordinary skill in this art would recognize that certain modifications would come within the scope of this disclosure. For that reason, the following claims should be studied to determine the true scope and content of this disclosure.

The invention claimed is:

1. A nozzle for use in an air cycle machine comprising:

a plate;

a plurality of vanes extending away from said plate, with said plurality of vanes extending for a height away from said plate and a width being defined as the closest distance between two adjacent vanes, with a ratio of said height to said width being between 0.3563 and 0.4051;

wherein there are 19 circumferentially spaced ones of said vanes; and wherein a total flow area is defined between all 19 of said vanes and said total flow area being between 0.3963 and 0.4505 square inches (2.5565-2.9066 centimeters).

2. The nozzle as set forth in claim 1, wherein said plate is formed of a base aluminum material provided with a tungsten carbide erosion coating.

3. An air cycle machine comprising:

a turbine rotor configured to drive a shaft, and a compressor rotor driven by said shaft, and a fan rotor driven by said shaft;

a nozzle provided adjacent said turbine rotor with said nozzle being at a location upstream of said turbine rotor;

said nozzle including a plate, a plurality of vanes extending in a second axial direction away from said plate, with said plurality of vanes extending for a height away from said plate and a width being defined as the closest distance between two adjacent vanes, with a ratio of said height to said width being between 0.3563 and 0.4051;

wherein there are 19 circumferentially spaced ones of said vanes; and wherein a total flow area is defined between all 19 of said vanes and said total flow area being between 0.3963 and 0.4505 square inches (2.5565-2.9066 centimeters).

4. The air cycle machine as set forth in claim 3, wherein said nozzle is a primary nozzle and is associated with a slider that moves relative to said primary nozzle dependent on flow condition to change a flow area, with said slider being movable between a closed position and a more open position, and said total flow area being defined at said closed position.

5. The air cycle machine as set forth in claim 4, wherein said slider is biased to the more open position.

6. The air cycle machine as set forth in claim 3, wherein said plate is formed of a base aluminum material provided with a tungsten carbide erosion coating.

7. A method of repairing an air cycle machine comprising the steps of:

(a) removing a nozzle from a location adjacent a turbine rotor in an air cycle machine, and replacing said removed nozzle with a replacement nozzle;

(b) the replacement nozzle including a plate, and a plurality of vanes extending away from said plate, with said plurality of vanes extending for a height away from said plate and a width being defined as the closest distance between two adjacent vanes, with a ratio of said height to said width being between 0.3563 and 0.4051;

wherein there are 19 circumferentially spaced ones of said vanes; and wherein a total flow area is defined between all 19 of said vanes and said total flow area being between 0.3963 and 0.4505 square inches (2.5565-2.9066 centimeters).

8. The method as set forth in claim 7, wherein said plate is formed of a base aluminum material provided with a tungsten carbide erosion coating.

* * * * *